US012139899B2

(12) United States Patent
Mukerji et al.

(10) Patent No.: US 12,139,899 B2
(45) Date of Patent: Nov. 12, 2024

(54) LINE PRESSURE-DRIVEN, TANKLESS, SIPHONIC TOILET

(71) Applicant: Kohler Co., Kohler, WI (US)

(72) Inventors: Sudip Mukerji, Mequon, WI (US); Michael J. Luettgen, Grafton, WI (US); William Kalk, Sheboygan, WI (US); Randy Mesun, Sheboygan, WI (US); Jeff Laundre, Sheboygan, WI (US); Jeremy Rauwerdink, Sheboygan, WI (US); John Esche, Kphler, WI (US); Keith Muellenbach, Sheboygan, WI (US); Clayton Garrels, Kohler, WI (US)

(73) Assignee: Kohler Co., Kohler, WI (US)

( * ) Notice: Subject to any disclaimer, the term of this patent is extended or adjusted under 35 U.S.C. 154(b) by 178 days.

(21) Appl. No.: 17/127,489

(22) Filed: Dec. 18, 2020

(65) Prior Publication Data

US 2021/0102364 A1 Apr. 8, 2021

Related U.S. Application Data

(63) Continuation of application No. 15/414,576, filed on Jan. 24, 2017, now Pat. No. 10,927,537.

(Continued)

(51) Int. Cl.

| | |
|---|---|
| ***E03D 11/18*** | (2006.01) |
| ***E03D 3/00*** | (2006.01) |
| ***E03D 5/10*** | (2006.01) |

(52) U.S. Cl.

CPC ..... *E03D 11/18* (2013.01); *E03D 3/00* (2013.01); *E03D 5/10* (2013.01); *E03D 2201/30* (2013.01)

(58) Field of Classification Search

CPC .. E03D 5/10; E03D 11/18; E03D 3/00; E03D 2201/30; B05B 1/04; B05B 1/083;

(Continued)

(56) References Cited

U.S. PATENT DOCUMENTS 423,175 A 3/1890 Newell
510,997 A * 12/1893 Smith ..... E03D 11/08 251/126

(Continued)

FOREIGN PATENT DOCUMENTS

CN 1422355 A 6/2003
CN 1555447 A 12/2004

(Continued)

OTHER PUBLICATIONS

CN-106759757-A Machine Translation (Year: 2022).*

(Continued)

*Primary Examiner* — David P Angwin
*Assistant Examiner* — William R Klotz
(74) *Attorney, Agent, or Firm* — Lempia Summerfield Katz LLC

(57) ABSTRACT

A tankless toilet includes a bowl, a trapway, and a jet. The bowl includes a rim at an upper portion of the bowl and a sump at a lower portion of the bowl. The trapway extends from the sump to a drain. The jet includes a main channel configured to receive a supply of water from a supply conduit, and a plurality of distribution channels configured to introduce water received from the main channel to at least one of the sump and the trapway. The jet is configured to receive the supply of water from the supply conduit at a first flow rate and induce a flow from the supply of water into the trapway at a second flow rate greater than the first flow rate to prime a siphon within the trapway. The second flow rate is greater than the first flow rate prior to priming the siphon.

18 Claims, 14 Drawing Sheets

Related U.S. Application Data

(60) Provisional application No. 62/286,561, filed on Jan. 25, 2016.

(58) Field of Classification Search
CPC ..... B05B 1/3405; B05B 1/341; B05B 3/0418; B05B 3/0422; B05B 3/0427; B05B 3/0463; B05B 3/06
USPC ..... 4/425; 239/222.15, 463, 501, 380, 381
See application file for complete search history.

(56) References Cited

U.S. PATENT DOCUMENTS

| | | | | |
|---|---|---|---|---|
| 550,336 | A * | 11/1895 | Williams | B05B 1/3402 239/489 |
| 769,520 | A | 9/1904 | Waldmann | |
| 1,132,953 | A | 3/1915 | Mann | |
| 1,928,717 | A | 10/1933 | Campus | |
| 1,973,349 | A | 9/1934 | Kruse | |
| 3,224,013 | A | 12/1965 | Tubbs | |
| 4,086,668 | A | 5/1978 | Tubbs | |
| 4,241,464 | A * | 12/1980 | Buckwalter | E04H 4/12 210/167.16 |
| 5,052,060 | A | 10/1991 | Makita | |
| 6,247,193 | B1 | 6/2001 | Riepl | |
| 6,263,519 | B1 | 7/2001 | Parsons | |
| 6,321,395 | B1 | 11/2001 | Parsons | |
| 6,370,707 | B1 | 4/2002 | Parsons | |
| 6,397,405 | B1 | 6/2002 | Grech | |
| 6,425,145 | B1 | 7/2002 | Parsons | |
| 6,453,479 | B1 | 9/2002 | Parsons | |
| 6,675,399 | B1 | 1/2004 | Tomita | |
| 6,823,535 | B2 | 11/2004 | Tomita | |
| 6,934,976 | B2 | 8/2005 | Parsons | |
| 7,036,159 | B2 | 5/2006 | Tomita | |
| 7,069,604 | B2 | 7/2006 | Tomita | |
| 7,305,721 | B2 | 12/2007 | Matsui | |
| 7,594,282 | B2 | 9/2009 | Shirai | |
| 7,640,604 | B2 | 1/2010 | Cummings | |
| 7,963,462 | B1 * | 6/2011 | Ramos, Sr. | B05B 3/063 239/233 |
| 8,032,956 | B2 | 10/2011 | Prokopenko | |
| 8,316,475 | B2 | 11/2012 | Grover | |
| 8,418,277 | B2 | 4/2013 | Okubo | |
| 8,756,722 | B2 * | 6/2014 | Inglin | E03D 11/02 4/421 |
| 8,793,818 | B2 | 8/2014 | Inglin | |
| 9,045,887 | B2 | 6/2015 | O'malley | |
| 9,737,181 | B1 | 8/2017 | Hall | |
| 2003/0088910 | A1 * | 5/2003 | Hidetaka | E03D 3/06 4/425 |
| 2003/0173421 | A1 * | 9/2003 | Schorn | B05B 3/0418 239/380 |
| 2005/0015871 | A1 | 1/2005 | Tomita | |
| 2006/0101566 | A1 | 5/2006 | Parsons | |
| 2008/0276362 | A1 | 11/2008 | Omalley | |
| 2010/0125940 | A1 | 5/2010 | Sigler | |
| 2011/0016623 | A1 * | 1/2011 | Inglin | E03D 11/08 4/420 |
| 2011/0078850 | A1 | 4/2011 | Inglin | |
| 2011/0231989 | A1 | 9/2011 | Omalley | |
| 2011/0314597 | A1 | 12/2011 | Von Ballmoos | |
| 2015/0107008 | A1 | 4/2015 | Kuo | |
| 2015/0354193 | A1 * | 12/2015 | Grönhaug | E03D 11/08 4/425 |
| 2020/0018055 | A1 * | 1/2020 | Garrels | E03D 3/00 |

FOREIGN PATENT DOCUMENTS

| | | | |
|---|---|---|---|
| CN | 203498964 | U | 3/2014 |
| CN | 106759757 | A * | 5/2017 |
| CN | 104988973 | B | 8/2017 |
| DE | 20120168 | U1 | 4/2003 |
| EP | 2843142 | A1 | 3/2015 |
| GB | 493000 | A | 9/1938 |
| JP | H06299585 | A | 10/1994 |
| JP | 2002088881 | A | 3/2002 |
| JP | 2004270163 | A | 9/2004 |
| WO | 8401973 | A1 | 5/1984 |
| WO | 2008024005 | A3 | 4/2008 |

OTHER PUBLICATIONS

International Search Report and Written Opinion issued in corresponding application No. PCT/US17/14787 mailed Apr. 10, 2017.

* cited by examiner

LINE PRESSURE-DRIVEN, TANKLESS, SIPHONIC TOILET

CROSS-REFERENCE TO RELATED PATENT APPLICATIONS

This application claims the benefit of and priority to U.S. patent application Ser. No. 15/414,576, filed on Jan. 24, 2017, which claims benefit to U.S. Provisional Application No. 62/286,561, filed Jan. 25, 2016, the entire disclosures of which are incorporated by reference herein.

BACKGROUND

The present application relates generally to toilets and urinals, and more specifically, to tankless toilets or urinals utilizing a siphon effect for flushing.

SUMMARY

One embodiment of the application relates to a tankless toilet. The tankless toilet includes a bowl, a trapway, and a jet. The bowl includes a rim at an upper portion of the bowl and a sump at a lower portion of the bowl. The trapway extends from the sump to a drain. The jet includes a main channel configured to receive a supply of water from a supply conduit, and a plurality of distribution channels configured to introduce water received from the main channel to at least one of the sump and the trapway. The jet is configured to receive the supply of water from the supply conduit at a first flow rate and induce a flow from the supply of water into the trapway at a second flow rate greater than the first flow rate to prime a siphon within the trapway. The second flow rate is greater than the first flow rate prior to priming the siphon.

Another embodiment relates to a method for flushing a tankless toilet. The method includes providing a first water flow from a supply conduit to a rim jet of a bowl for a first time interval. The method further includes providing a second water flow from the supply conduit to at least one of a sump and a trapway of the toilet via a sump jet for a second time interval to induce a siphon within the trapway. The sump jet includes a main channel configured to receive water from the supply conduit and a plurality of distribution channels configured to introduce water from the main channel to the at least one of the sump and the trapway.

Another embodiment relates to a plumbing fixture. The plumbing fixture includes a bowl, a trapway, and a jet. The bowl includes a rim at an upper portion of the bowl and a sump at a lower portion of the bowl. The bowl is configured to hold a volume of water therein. The trapway extends from the sump to a drain. The jet includes a main channel configured to receive a supply of water from a supply conduit and to direct the supply of water to at least one of the sump and the trapway. The jet is configured to receive the supply of water from the supply conduit at a first flow rate and introduce the supply of water to the at least one of the sump and the trapway at a second flow rate greater than the first flow rate to entrain the volume of water in the bowl and induce a siphon within the trapway. The second flow rate is greater than the first flow rate prior to inducing the siphon.

DETAILED DESCRIPTION

Figure 1:
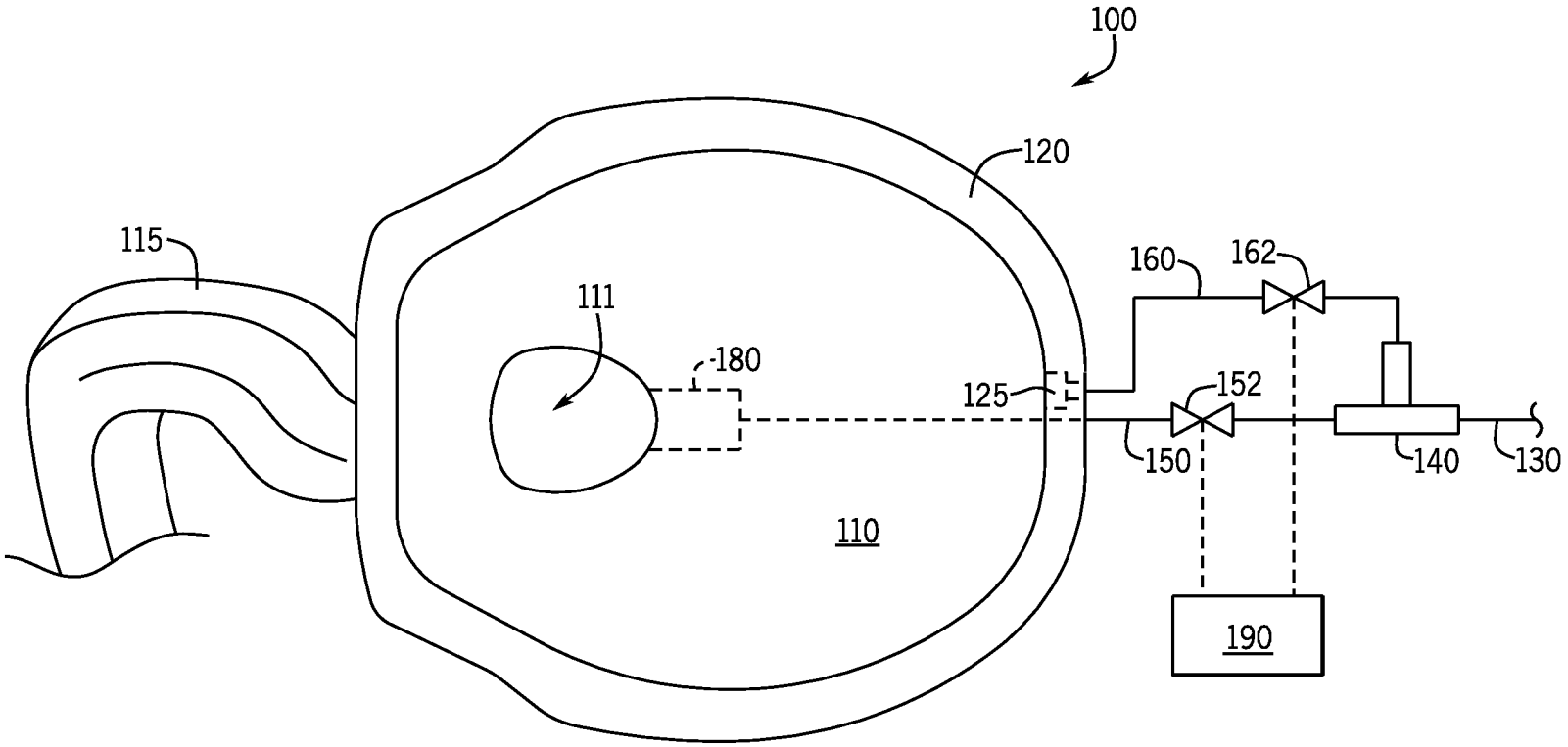
FIG. 1 is a top, schematic view of a tankless toilet, according to an exemplary embodiment.

In conventional applications, a toilet or urinal may rely on a siphon effect to induce a flushing action. These toilets typically require the use of a tank or reservoir, which holds a predetermined supply of water and is positioned above the toilet bowl. When a flush is activated, water flows from the tank due to gravity and is led through internal passages provided in the bowl to both rinse the inner surface of the bowl and prime the bowl for siphoning. A jet located in the sump of the bowl primes the siphon by delivering the water from the tank into the sump and a trapway, which provides the necessary suction for evacuating the bowl once the siphon action is induced. After completion of the flush, the tank is then refilled and the sump is filled with additional water to seal the trapway.

In these gravity-based designs, a high flow rate of water from the tank into the trapway is necessary to provide sufficient priming for the siphon. For example, typical sump jets need to deliver about 20 to 25 gallons per minute of water into the trapway to prime the siphon. Moreover, there has been a recent trend toward low water usage for toilets. To conserve overall water consumption, gravity-based toilet designs have begun to decrease the amount of water provided in the sump of the bowl in between flushes and increase water provided in the tank. This is because the water in the tank provides the energy needed to the prime the siphon and thus is considered "working" water, while the bowl water is inactive and must be removed during a flush, thereby consuming flush energy. Although this may enable lower water usage for gravity-based designs, because a smaller water volume is provided in the bowl between flushing, the propensity of soiling the bowl and leaving marks on the inner surface of the bowl is increased.

In other applications, a toilet may be provided without a tank. These toilet designs typically forego the siphon effect used by gravity-driven toilets and instead incorporate pumps, valves, and/or higher line pressures to produce the necessary flow rate for a flush. For example, flushometer toilets, which utilize a flushometer valve to control water flow into the bowl, typically require a large diameter supply line (e.g., 1.5 inches or greater) to deliver the necessary flow rate of water. In these designs, a high flow rate of water (e.g., about 15-20 gallons per minute) is provided to the sump to produce a "blow-out" action to evacuate the bowl, where the momentum of the water flowing out of the sump jet at the high flow rate pushes the water out and clears the bowl, rather than relying on suction induced by a siphon to draw the water from the bowl. These designs, however, are generally used in commercial applications, rather than residential, due to the need for higher supply line pressures and a very large diameter supply line, which is incompatible with the smaller diameter piping (e.g., ¾-inch piping) found in most residential homes In some tankless designs for residential applications, the toilet is connected to the supply line with a relatively large diameter pipe (e.g., about 0.5 inches), but these toilets generally require a high supply line pressure (e.g., about 45 to 50 psi) to effectively remove waste from the bowl. Moreover, these toilets rely on a blow-out action, rather than a siphon effect, to evacuate the bowl. In addition, many residential supply lines are configured to produce lower pressures, some as low as 30 psi, which is insufficient for many of these tankless designs.

It would be advantageous to provide a tankless toilet capable of producing a siphon effect even when operating under low line pressures, such as those supplied by household supply lines. These and other advantageous features will become apparent to those reviewing the disclosure and drawings.

Referring generally to the FIGURES, disclosed herein is a tankless toilet or other plumbing fixture (e.g., urinal, etc.) that utilizes a siphon effect to produce a flushing action without requiring the use of a pump or pressure vessel. In particular embodiments, the tankless toilet may be connected to a household water supply line, which provides a flow rate of water at pressures as low as 30 psi. The tankless toilet may also be connected to the water supply line by a nominal 0.5-inch diameter hose. Such a configuration would normally deliver about a 4.6 gpm water flow rate to the toilet, which is insufficient to induce a siphon action. However, in certain embodiments, the tankless toilet described herein can increase the flow rate of water in the sump and trapway to a flow rate comparable to a conventional gravity-based design (e.g., about 20-25 gpm) to initiate the siphon effect. Thus, the tankless toilet may be used with existing residential plumbing with minimal added equipment and needed installation. Moreover, with a tankless design, the toilet provides a lower profile, thereby increasing the aesthetics of the overall design. Although the figures and description below focus primarily on the application of toilets, it is appreciated that various features of the tankless toilet design described below may be applied to other types of plumbing fixtures, such as urinals or the like.

Figure 2:
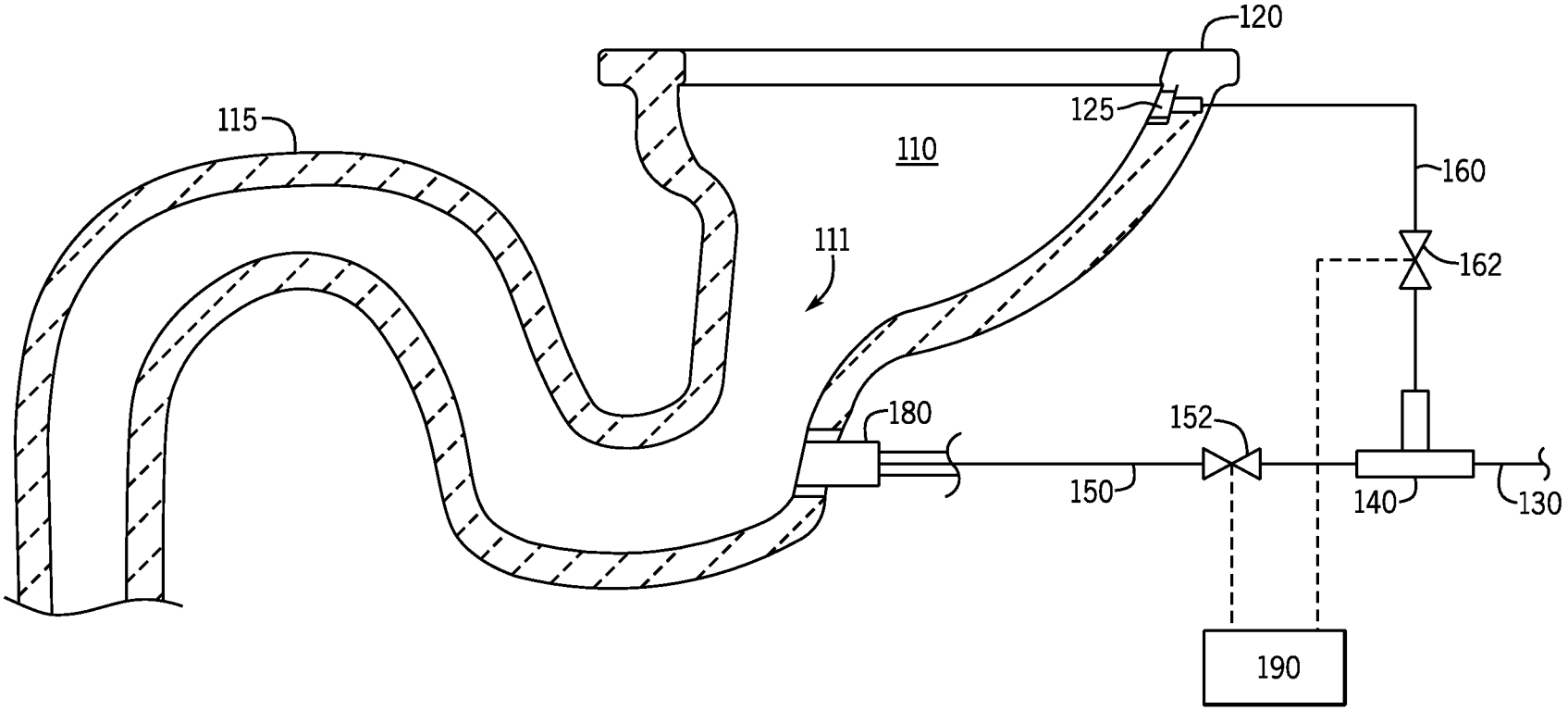
FIG. 2 is a cross-sectional, schematic view of the tankless toilet shown in FIG. 1.

FIGS. 1-2 show a tankless toilet 100 according to an exemplary embodiment. The toilet 100 includes a bowl 110 surrounded circumferentially by a rim 120. Located at the bottom of the bowl 110 is a sump 111, which houses a predetermined volume of water to seal a trapway 115 that is configured to induce a siphon effect, which provides pressure to suction waste water from the bowl 110 when a flush is activated. A jet 180, described in more detail below, is coupled to and in fluid communication with the sump 111.

As further shown in FIGS. 1-2, water is supplied to the tankless toilet 100 through a supply conduit 130 that is connected to a water supply line, such as a normal household supply line that supplies water at a pressure of about 30 psi. The supply conduit 130 leads from the supply line to a connector 140. The connector 140, such as, for example, a T-connector, allows water to be supplied to the sump 111 through a sump supply conduit 150 and the rim 120 through a rim supply conduit 160. According to some embodiments, the T-connector is not required, which is dependent upon the particular valve design used. The sump supply conduit 150 is connected to the jet 180 located at the sump 111 to supply water into the sump 111. The rim supply conduit 160 is configured to supply water to the rim 120, which allows water to flow along an inner surface of the bowl 110 through a rim jet 125 or a plurality of rim jets located at an underside of the rim 120. The rim jet may have any appropriate cross-section, such as a circular or oval cross-section. In certain embodiments, the rim jet has an oval cross-section with a length of about 0.75 inches and a width of about 0.12 inches.

As shown in FIGS. 1-2, each of the sump supply conduit 150 and the rim supply conduit 160 is connected to a valve 152, 162, respectively, which controls the flow of water from the supply conduit 130 to the sump supply conduit 150 and the rim supply conduit 160, respectively. The valves 152 and 162 may be electronically controlled by a controller 190, which may be configured to open and close the valves 152, 162 after predetermined time intervals. The controller 190 may open and close the valves 152, 162 to initiate a multi-stage flush process that both cleans the bowl and evacuates the bowl during a flush. For example, during a multi-stage flush process according to certain embodiments, once a flush is activated by a user using an activation mechanism such as a handle or a button, the controller 190 opens the valve 162 to supply water to the rim supply conduit 160 and the rim 120. Through the rim jet (or a plurality of rim jets), water flows from the underside of the rim 120 along the inner surface of the bowl 110 to rinse and clean the bowl 110 of debris. In particular embodiments, the valve 162 is configured to allow the full pressure and flow from the supply line through the rim jet. By allowing water to flow at full line pressure, water exiting the rim jet can clean the entire inner surface of the bowl 110 without the use of a ledge or shelf structure on the inner surface of the bowl 110 to help guide the water. Moreover, water flowing out from the rim jet at full line pressure and flow reduces the need to provide a more compact bowl 110 to ensure that the entire inner surface will be cleaned by the water.

After a first predetermined time interval, the controller 190 then closes the valve 162 and opens the valve 152 to allow water to flow from the sump supply conduit 150 to the jet 180. As will be described in more detail below, the jet 180 is configured so as to concentrate the flow of water, which may flow from the supply conduit 130 at a rate as low as 4.6 gpm, and amplify the flow rate of water in the sump 111 via flow entrainment. The rapid diffusion of water from the jet 180 accelerates the water contained in the sump 111 such that the necessary flow rate (e.g., a flow rate of about 20-25 gpm) is provided to the trapway 115 to prime the siphon and evacuate the bowl 110 of waste water.

After a second predetermined time interval, the controller 190 closes the valve 162 and then re-opens the valve 152. Water is then supplied to the rim 120 to once again rinse and clean any remaining waste on the inner surface of the bowl 110 and to re-fill the sump 111 to seal the bowl 110 after the flush has completed. After a third predetermined time interval, the valve 162 is closed by the controller 190. The predetermined time intervals may be precisely set depending on the characteristics of the toilet 100, such as the static line pressure, the configuration of the jet 180, and the shape of the trapway 115. For example, depending on the jet configuration (e.g., the size and number of orifices, described below), the second predetermined time interval may range from about 0.1 seconds to about 4 seconds at supply line pressures ranging from about 25 psi or higher. According to certain embodiments, the second predetermined time interval may be set to occur over 3.5 seconds, thus allowing water to flow through the jet 180 for a total flow of 0.27 gallons, which is equivalent to about 4.6 gpm at a supply line pressure of about 30 psi. Moreover, the predetermined time intervals may be set to occur consecutively, with a predetermined delay, or may be set to overlap slightly over a predetermined time. For example, in certain embodiments, the first predetermined time interval is set to occur over 1.3 seconds, followed by a delay of about 1 millisecond to minimize overlap between the opening of the valves 152, 162, the second predetermined time interval is set to occur over 3.5 seconds, followed by a delay of about 1 millisecond, and the third predetermined time interval is set to occur over 7.3 seconds to further wash and refill the bowl 110. In particular embodiments, the predetermined time intervals for when water is supplied to the rim 120 or the jet 180 may be set to be shorter at higher supply line pressures.

Figure 3:
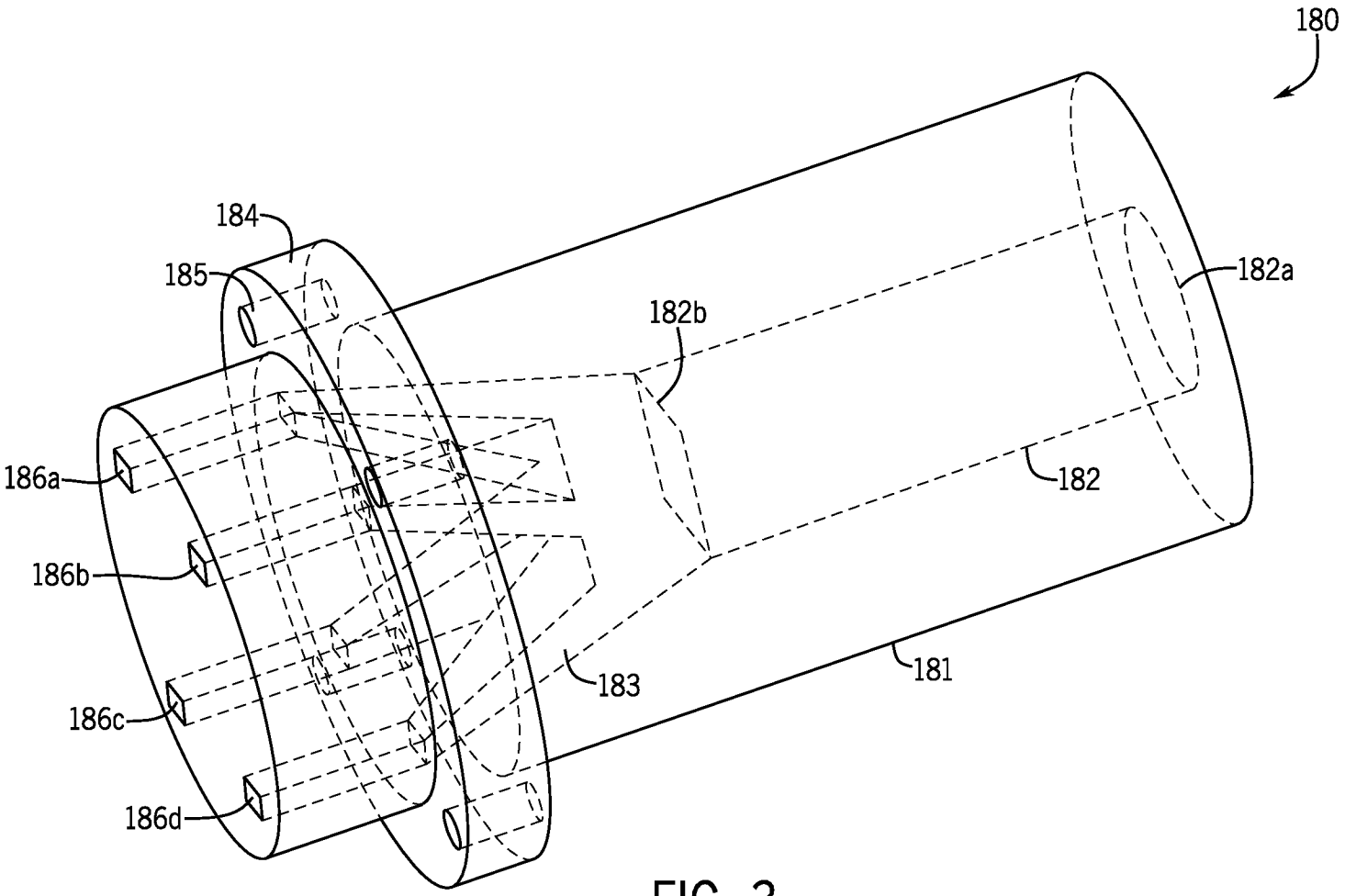
FIG. 3 is a detailed, perspective view of a jet for the tankless toilet shown in FIG. 1, according to an exemplary embodiment.
Figure 4A:
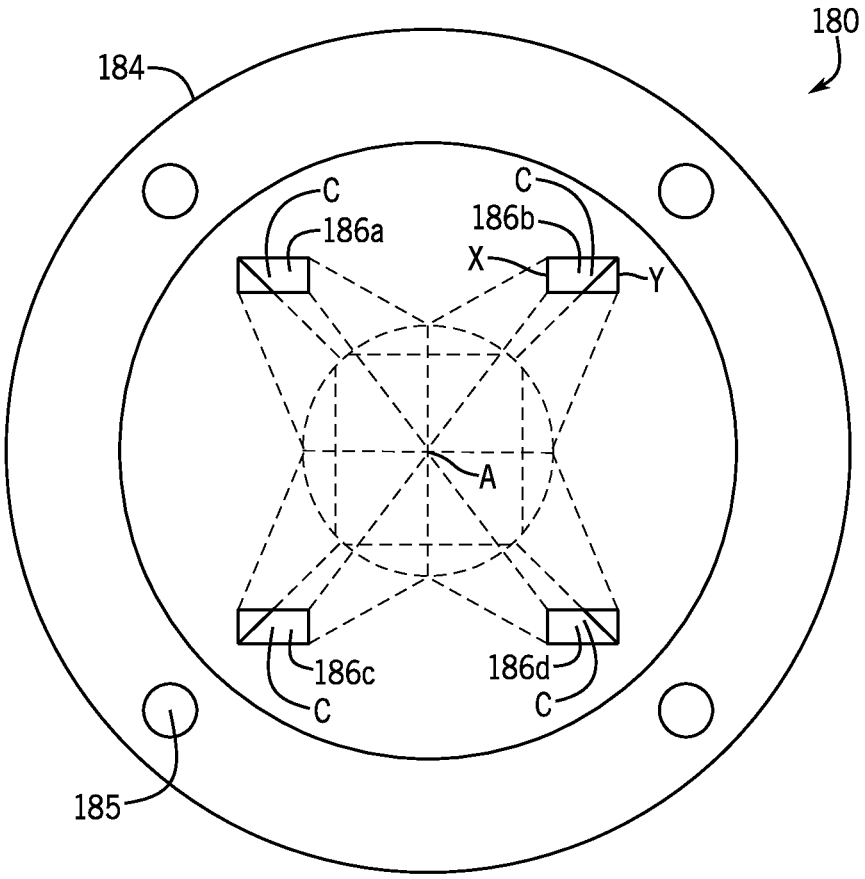
FIGS. 4A-4C are front, top, and side views of the jet shown in FIG. 3.
Figure 4B:
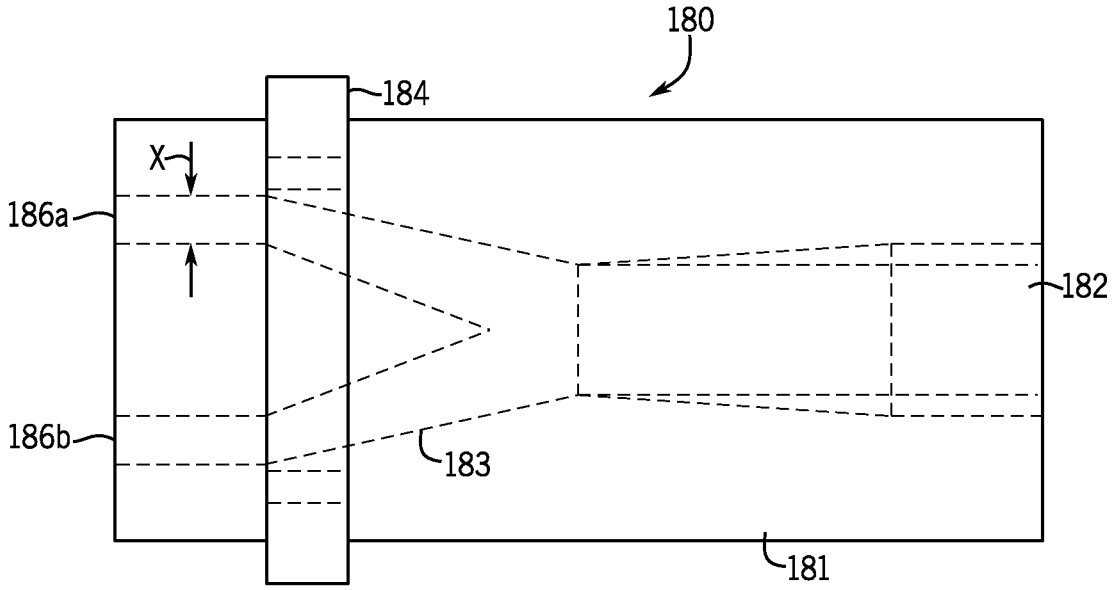
Figure 4C:
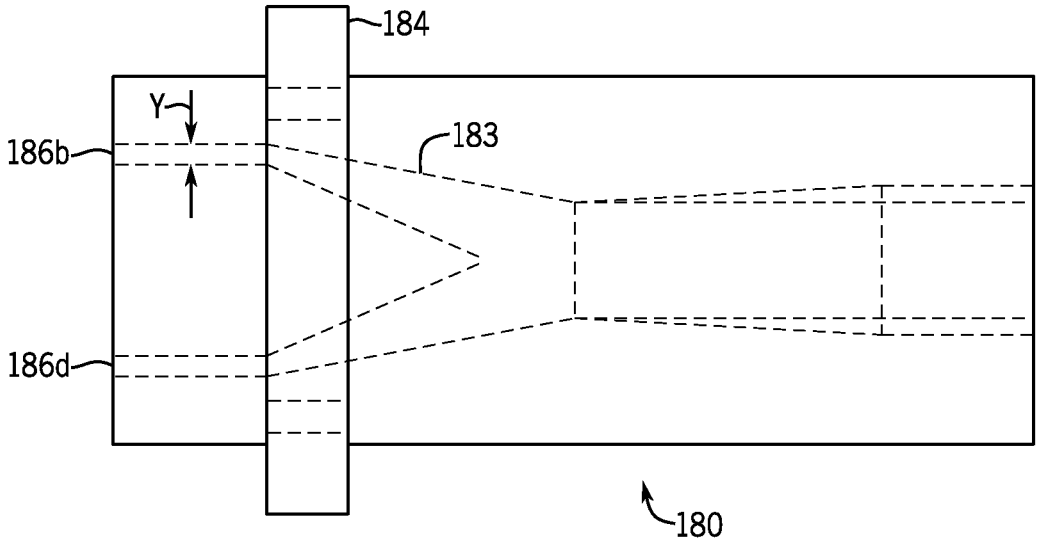

FIG. 3 shows a detailed, perspective view of a first embodiment of the jet 180. FIGS. 4A-4C illustrate front, top, and side views of the jet 180, respectively. As shown, the jet 180 has an outer sleeve 181 that surrounds a main inflow channel 182, which is configured to be connected to the sump supply conduit 150. The jet 180 further includes a connection flange 184, which has a plurality of attachment holes 185 for coupling the jet to the toilet 100. As shown in FIG. 3, the main inflow channel 182 branches off into a plurality of distribution channels 183, which distributes water through a plurality of small outlet orifices 186*a*-186*d*. The distribution channels 183 are narrower than the main inflow channel 182. As shown in FIG. 3, an inlet side 182*a* of the main channel 182 has a circular cross-section to allow for installation to the sump supply conduit 150. In some embodiments, the inlet side 182*a* includes a circular cross-section having about a 0.56-inch diameter such that a 0.5-inch NPT thread may be attached. Moreover, as further shown in FIG. 3, an outlet side 182*b* of the main inflow channel 182 may include a square cross-section, which then splits into the four distribution channels 183, each having substantially equal cross-sectional areas. In certain embodiments, the square cross-section of the outlet side 182*b* has sides of about 0.425 inches in length.

In the embodiment shown in FIG. 3, four channels 183 lead to four outlet orifices 186*a*-186*d*, which serve to concentrate the flow of water from the sump supply conduit 150 and rapidly diffuse the concentrated flow into the sump 111 to prime or induce the siphon effect. As shown in FIG. 4A, the four orifices 186*a*-186*d* are approximately equal distance in a radial direction from a center A of the jet 180. In certain embodiments, the two horizontally-aligned orifices (e.g., 186*a* and 186*b*) are separated by a distance of about 17.5 millimeters, as measured from a center C of the respective orifice. In addition, in certain embodiments, the two vertically-aligned orifices (e.g., 186*a* and 186*c*) are separated by a distance of about 19.7 millimeters, as measured from a center C of the respective orifices. Moreover, in the particular embodiment shown, the orifices are substantially rectangular in shape. As shown in FIGS. 4A-4C, the width X of the outlet orifices may be set to be greater than the height Y of the outlet orifices. In particular embodiments, the outlet orifices may each have a width X of about 4.1 millimeters and a height Y of about 1.9 millimeters.

Figure 5A:
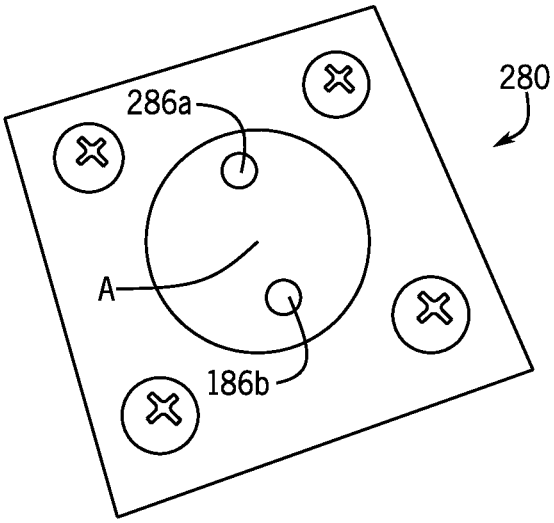
FIGS. 5A-5C are detailed views of jets for the tankless toilet shown in FIG. 1, according to additional embodiments.
Figure 5B:
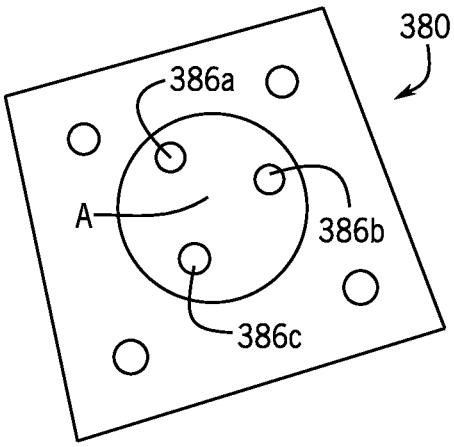
Figure 5C:
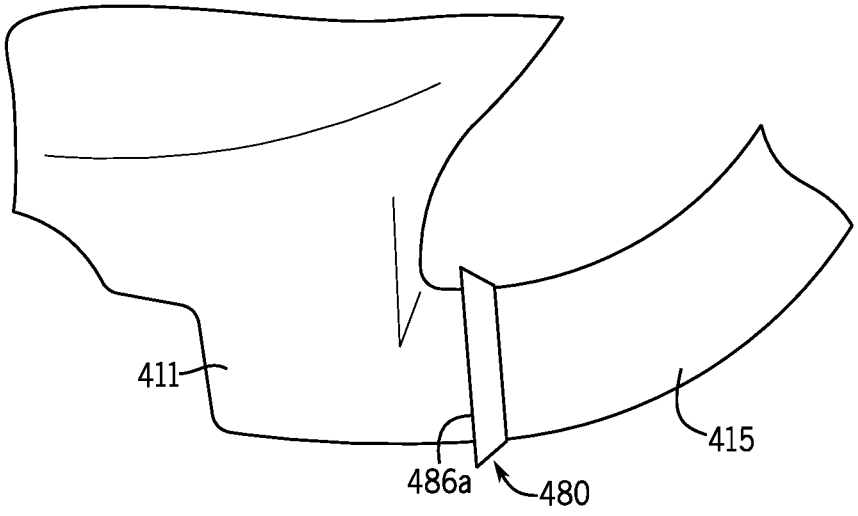

The number and shape of the outlet orifices contained in the jet 180 is not particularly limited. For example, FIGS. 5A-5C show additional embodiments of a jet having various orifice shapes and numbers. FIG. 5A shows a jet 280 having two circular orifices 286*a* and 286*b* arranged along a common line running through the center A of the jet 280. In addition, FIG. 5B shows a jet 380 having three circular orifices 386*a*-386*b* arranged in an equilateral triangle having a center coinciding with the center A of the jet 380. Alternatively, as shown in FIG. 5C, a jet 480 having a single outlet orifice 486*a* in the form of the annular jet is provided around the entire circumferential periphery of the trapway 115. In certain embodiments, the jet may include one to four orifices, each of which may have a width and/or diameter of about 1/16 inches to about 7/16 inches.

According to an exemplary embodiment, the jet 180 is configured to rotate relative to the sump 111, so as to further enhance flow entrainment. For example, the jet 180 can be rotatably coupled to the sump 111 via one or more bearings or other suitable mechanism/device to facilitate relative rotation between the jet 180 and the sump 111. According to an exemplary embodiment, the jet 180 can freely rotate relative to the sump 111 upon receiving a supply of water from the sump supply conduit 150. According to other exemplary embodiments, the jet 180 includes a motor (e.g., an electric servo motor, etc.) and a controller (e.g., controller 190) configured to selectively control operation of the motor to thereby control rotational movement of the jet 180 relative to the sump 111. In this way, the rotatable jet 180 can effectively create a "rifling" effect with the flow of water received from the sump supply conduit 150 to increase entrainment and flow amplification, to thereby prime or induce the siphon in the trapway 115 of the tankless toilet 100.

According to an exemplary embodiment, one or more of the outlet orifices 186*a-d* of the jet 180 is oriented to direct a flow of water toward a particular surface or object within the sump to thereby impinge the jet streams exiting the jet 180 and increase entrainment. According to another exemplary embodiment, two or more of the outlet orifices 186*a-d* may be oriented toward each other to focus/direct the flow(s) exiting the jet 180 and increase entrainment. In this manner, the outlet orifices 186*a-d* can, advantageously, increase entrainment and prime or induce the siphon in the trapway 115 of the tankless toilet 100. For example, one or more of the outlet orifices 186*a-d* may be facing toward an interior surface of the sump 111, such as an interior wall or other surface within the sump 111 (e.g., an impact surface, a protrusion, etc.), such that a flow of water exiting the outlet orifice(s) can impinge on the surface to thereby increase entrainment of the flow. Similarly, two or more of the outlet orifices 186*a-d* can be oriented toward each other such that a flow of water exiting the two or more orifices is combined or is focused in the same direction to increase entrainment of the flows.

According to an exemplary embodiment, one or more of the distribution channels 183 may include a rounded edge at a distal end of the channel to further enhance entrainment. For example, one or more of the distribution channels 183 may terminate at a distal end adjacent the outlet orifices 186*a-d* nearest the sump 111 of the tankless toilet 100. At least a portion of (or all of) the edge surrounding the distal end of the outlet orifice(s) 186*a-d* of each of the distribution channels 183 may have a filleted or rounded edge to increase the spread or distribution of water exiting each of the orifices, which in turn can increase entrainment.

Figure 6:
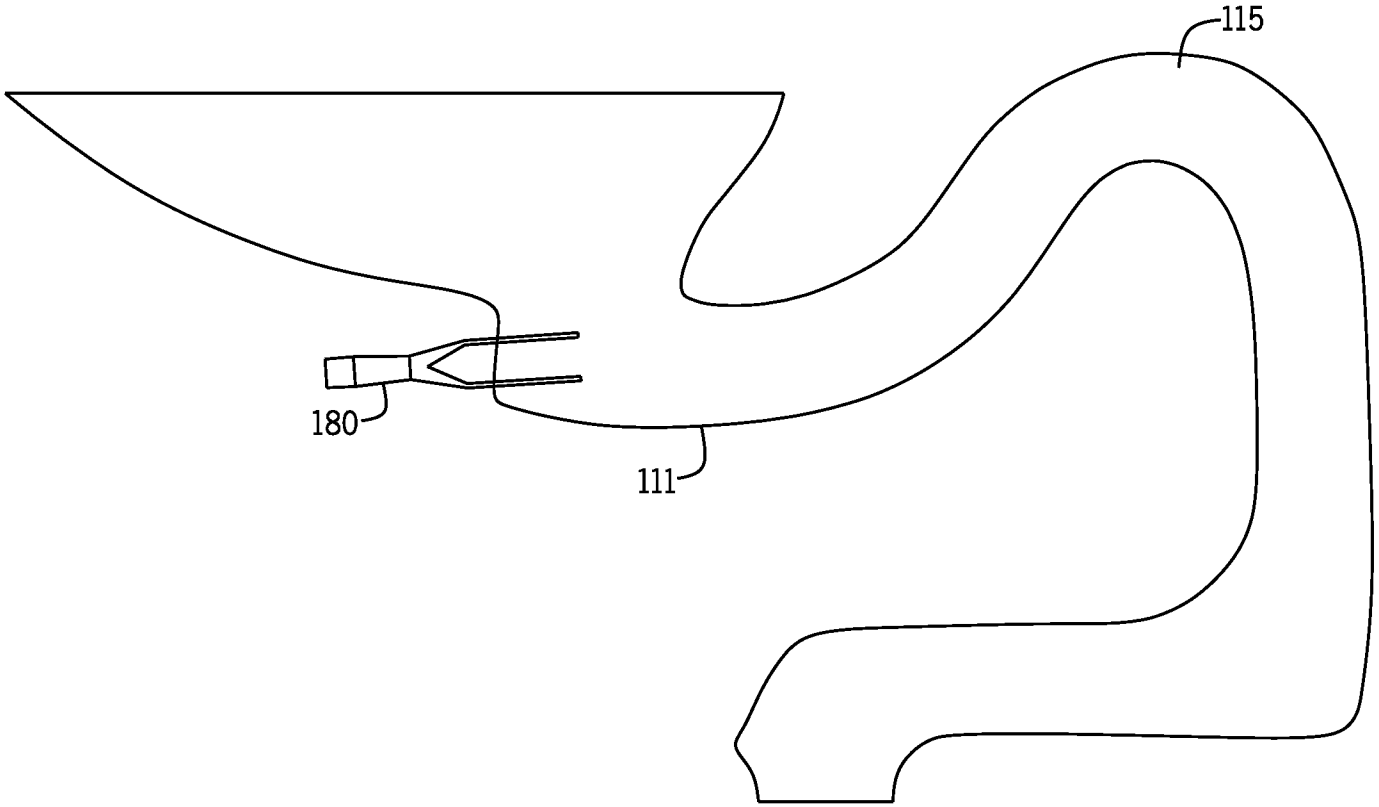
FIG. 6 is a detailed side view of a jet connection for the tankless toilet shown in FIG. 1, according to an exemplary embodiment.

The jet 180 may also be positioned to further enhance the amplification of water into the sump 111 to prime or induce the siphon in the trapway 115. For example, as shown in FIG. 6, the jet 180 may be connected to the toilet 100 at a front end of the sump 111 opposite the trapway 115. The jet 180 may be upwardly angled from a bottom surface of the sump 111. In particular embodiments, the jet 180 is upwardly angled from the bottom surface of the sump 111.

The jet 180 may be upwardly angled from the bottom surface of the sump 111 by an angle within the range of zero degrees to about ten degrees. In particular embodiments, the jet 180 is upwardly angled by about four degrees to about six degrees. In certain embodiments, the jet 180 is upwardly angled by about four degrees from the bottom surface of the sump 111. Such an upward angle allows rapid priming of the siphon to occur in the trapway 115, which, in some cases, allows the siphon to occur faster than typical gravity-based toilet designs. In addition, the bottom surface of the sump 111 may be downwardly angled from the jet 180 to enhance evacuation of the bowl and prevent return flow of waste water from the trapway 115. In certain embodiments, the sump 111 is downwardly angled from the jet 180 by about six degrees.

Figure 7A:
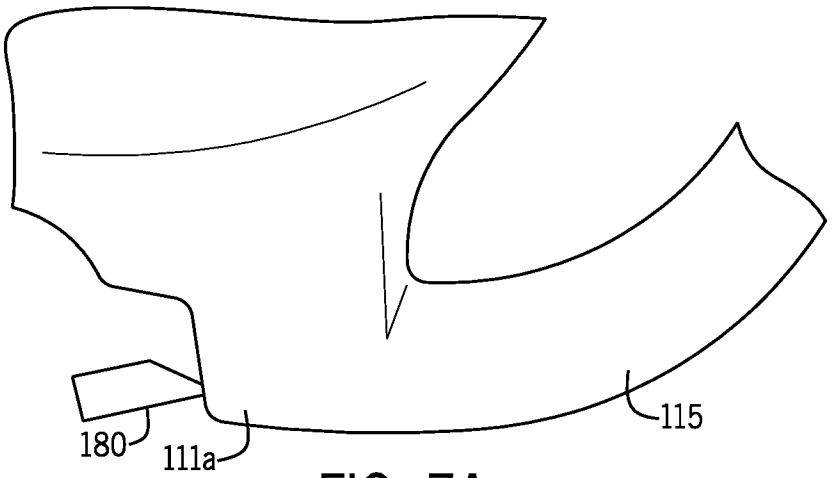
FIGS. 7A-7C are detailed views of jet connections to the tankless toilet shown in FIG. 1, according to additional embodiments.
Figure 7B:
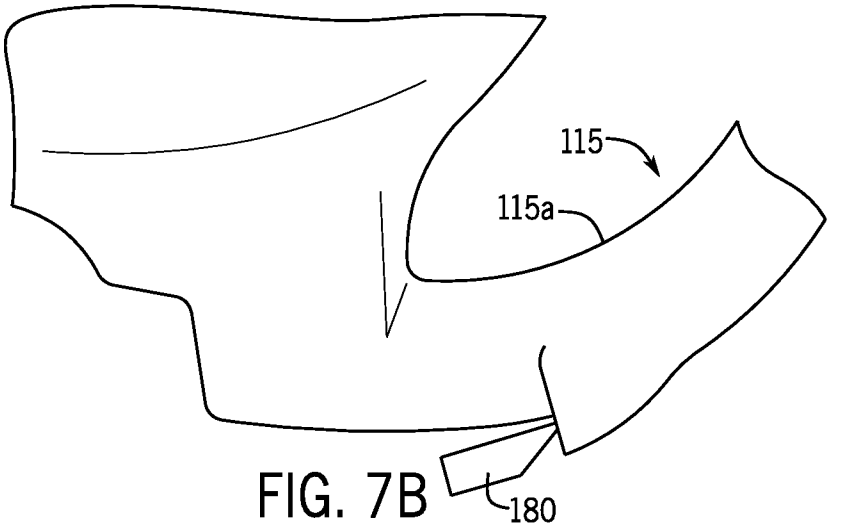
Figure 7C:
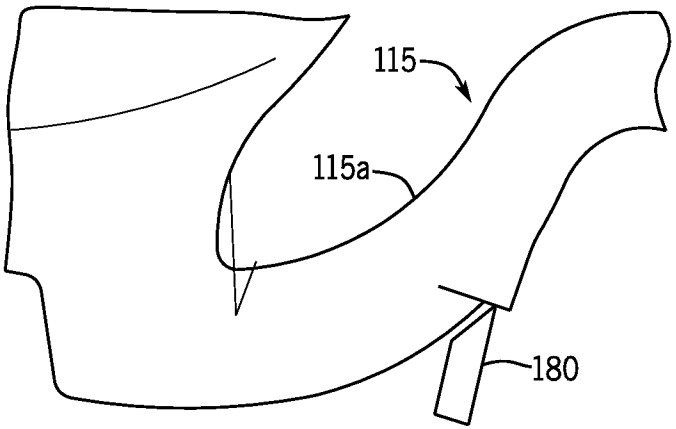

FIGS. 7A-7C show various other embodiments for the connection of the jet 180 to the toilet 100. For example, as shown in FIG. 7A, the jet 180 may be connected to a shortened sump 111*a*. The shortened sump 111*a* may include a narrower lower portion at which the jet 180 is connected, thus reducing the distance between the jet 180 and the mouth of the trapway 115. In addition, as shown in FIG. 7B, the jet 180 may be connected to a lower part of the upleg portion 115*a* of the trapway 115 or, as shown in FIG. 7C, the jet 180 may be connected to an upper part of the upleg portion 115*a* of the trapway 115.

The sump 111 may also be configured to optimize the flow of water into the trapway 115 to prime the siphon action. For example, the sump 111 may have various lengths and bowl volumes that are determined based on the configuration and placement of the jet 180 such that the amplification of water flowing out of the jet 180 is further enhanced. In certain embodiments, the sump 111 may be configured with a length such that the distance between the jet 180 and the mouth of the trapway 115 ranges from about 3 inches to about 9 inches. In addition, in certain embodiments, the sump 111 may be configured with a bowl volume that ranges from about 0.6 gallons to about 0.8 gallons.

FIGS. 8-13 illustrate various jet configurations that are configured for use in conjunction with the tankless toilet 100, according to various exemplary embodiments.

Figure 8:
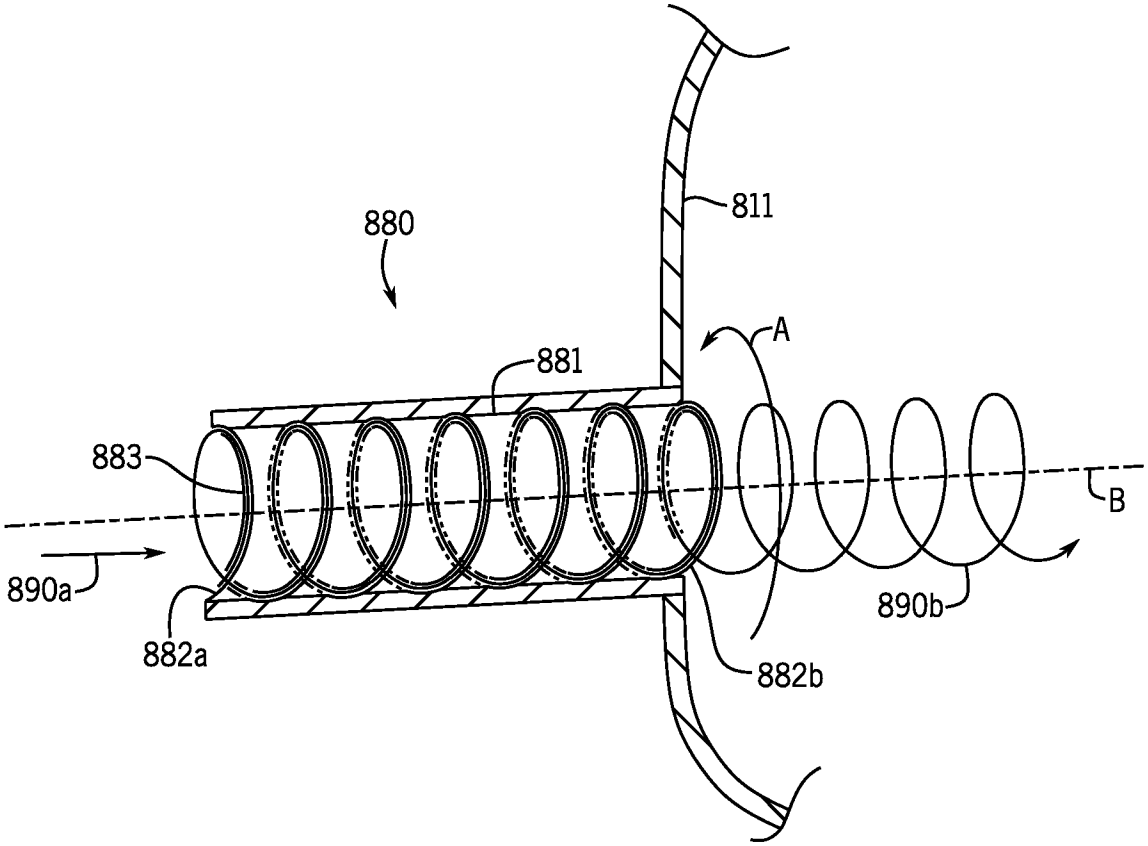
FIGS. 8-13 illustrate various jet configurations for the tankless toilet shown in FIG. 1, according to various exemplary embodiments.

According to an exemplary embodiment shown in FIG. 8, a jet 880 is coupled to a sump 811 of a tankless toilet, such as the tankless toilet 100. The sump 811 can be identical to the sump 111 of the tankless toilet 100 or may be configured differently, according to other exemplary embodiments. The jet 880 can be positioned at similar locations on the sump 111 as the jet 180 discussed above, according to various exemplary embodiments. The jet 880 has an inner structure that can, advantageously, spin or rotate a flow of water through an interior portion of the jet 880, so as to entrain the flow of water before leaving the jet 880 and entering the sump 111. In this manner, the jet 880 can provide a similar effect as the effect created by the jet 180 (i.e., the effect created by "axis shifting" between the elliptical shaped jets and the rectangular shaped jets of the jet 180). Thus, the jet 880 can improve entrainment and flow amplification effect, to thereby prime or induce the siphon in the trapway of the tankless toilet 100 (e.g., trapway 115).

Still referring to FIG. 8, the jet 880 has a generally hollow, cylindrical shape defined by a wall 881. The wall 881 defines a main channel including one or more spiral features 882 (e.g., spiral ribs, spiral protrusions, spiral channels, helical ribs/channels, etc.) extending through at least a portion of, or along the entire length of, the main channel. The jet 880 includes an inlet 882*a* at one end and an outlet 882*b* at a second opposite end. The jet 880 is coupled to, and in fluid communication with, the sump 811 at the outlet 882*b*. The jet 880 is also in fluid communication with a sump supply conduit (e.g., sump supply conduit 150) at the inlet 882*a*. According to the exemplary embodiment shown in FIG. 8, a supply of water 890*a* from the sump supply conduit is provided to the main channel of jet 880 at the inlet 882*a*. The supply of water is passed through the main channel of the jet 880 and is entrained by the one or more spiral features 883 extending along the wall 881 of the jet 880. The entrained supply of water 890*b* can enter the sump 811 through the outlet 882*b*. Although the jet 880 is shown to include only a single orifice/main channel according to the exemplary embodiment of FIG. 8, the jet 880 may include a plurality of orifices/channels having similar structures to provide additional entrainment/flow amplification, according to other exemplary embodiments.

According to an exemplary embodiment, the jet 880 is configured to rotate relative to the sump 811, as illustrated by arrow "A," about an axis, shown as axis "B" in FIG. 8. For example, the jet 880 can include a dynamic element or mechanism (e.g., a bearing, etc.) that can rotate or spin upon receiving a flow of water (i.e., the force of the flow of water can cause the dynamic element to rotate). According to another exemplary embodiment, the jet 880 can include a motor or other rotary actuator that can cause rotation of the jet 880 and the flow of water. In this manner, the jet 880 can provide additional entrainment by spinning the water.

Figure 9:
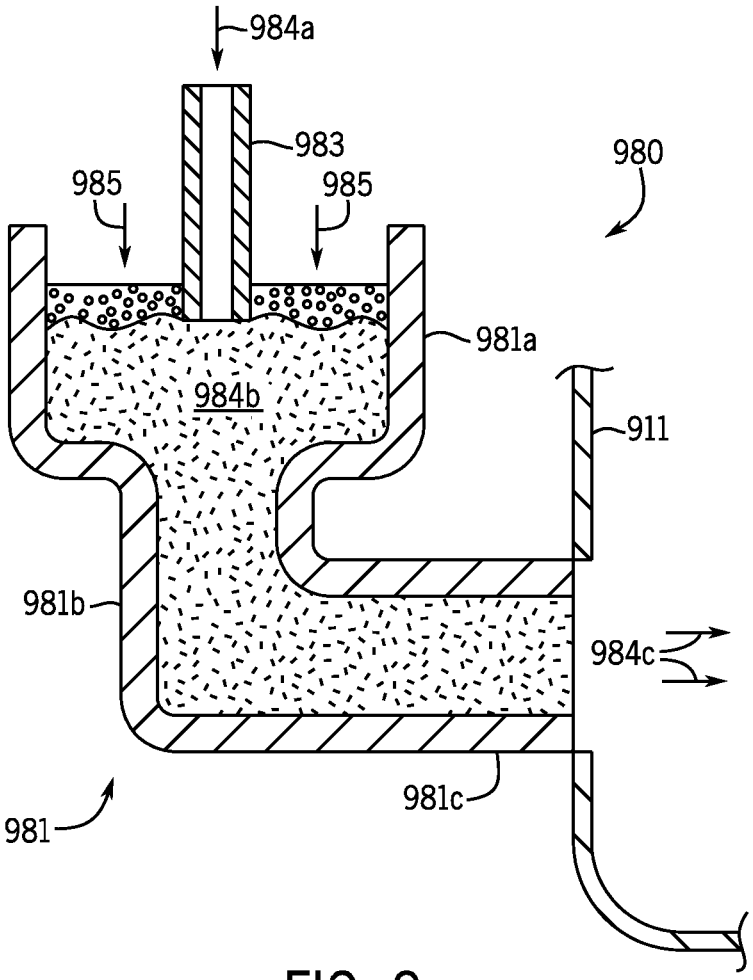

Referring to FIG. 9, a jet assembly 980 is shown according to another exemplary embodiment. The jet assembly 980 is configured to act as a piston by using air (or similar type of fluid) to pressurize and accelerate a volume of water through a housing before entering the sump of a tankless toilet. In this manner, the jet assembly 980 can, advantageously, improve entrainment and flow amplification effect, to thereby prime or induce the siphon in the trapway of the tankless toilet.

As shown in FIG. 9, the jet assembly 980 includes a housing 981 (e.g., piston housing, etc.) coupled to (or integrally formed with) a sump 911 of a tankless toilet, such as the tankless toilet 100. The housing 981 includes a mouth portion 981*a* (e.g., upper portion, wider portion, etc.), a neck portion 981*b* (e.g., lower portion, narrower portion, etc.), and an outlet portion 981*c* (e.g., leg portion, extension, etc.) extending substantially perpendicular from the neck portion 981*b*. The housing 981 is coupled to, and in fluid communication with, the sump 911 via the outlet portion 981*c*. The housing 981 defines an interior space for holding a volume of water 984*b* therein. According to the exemplary embodiment of FIG. 9, the mouth portion 981*a* has a diameter that is wider than the diameter of the neck portion 981*b* and the outlet portion 981*c*, which are each disposed below the mouth portion 981*a*. This structural configuration can, advantageously, act to increase the velocity of a flow of water flowing through the housing 981 from the mouth portion 981*a* to the outlet portion 981*c*.

Still referring to FIG. 9, the jet assembly 980 further includes an inlet conduit 983 (e.g., main channel, etc.) disposed in the mouth portion 981*a* of the housing. The housing 981 can substantially surround at least a portion of the inlet conduit 983. The inlet conduit 983 is in fluid communication with a sump supply conduit (e.g., sump supply conduit 150) to provide a supply of water 984*a* to the housing 981 (i.e., to supply the volume of water 984*b* within the housing 981). In the embodiment shown in FIG. 9, the inlet conduit 983 can provide a volume of water 984*b* that fills the housing 981 to a level below or adjacent to the distal end of the inlet conduit 983. The housing 981 is also in fluid communication with an air supply source to provide pressurized air 985 within the mouth portion 981*a* above the volume of water 984*b*. According to an exemplary embodiment, the pressurized air 985 is supplied by a source located remotely from the tankless toilet 100. According to other exemplary embodiments, the air supply source is located on/in the tankless toilet 100. The pressurized air 985 can, advantageously, compress and accelerate the volume of water 984*b* through the mouth portion 981*a*, the neck portion 981*b*, and the outlet portion 981*c* of the housing to provide a flow of water 984*c* having an increased velocity into the sump 911. The increased flow of water 984*c* can improve entrainment and flow amplification effect to thereby prime or induce the siphon in the trapway of the tankless toilet.

Figure 10:
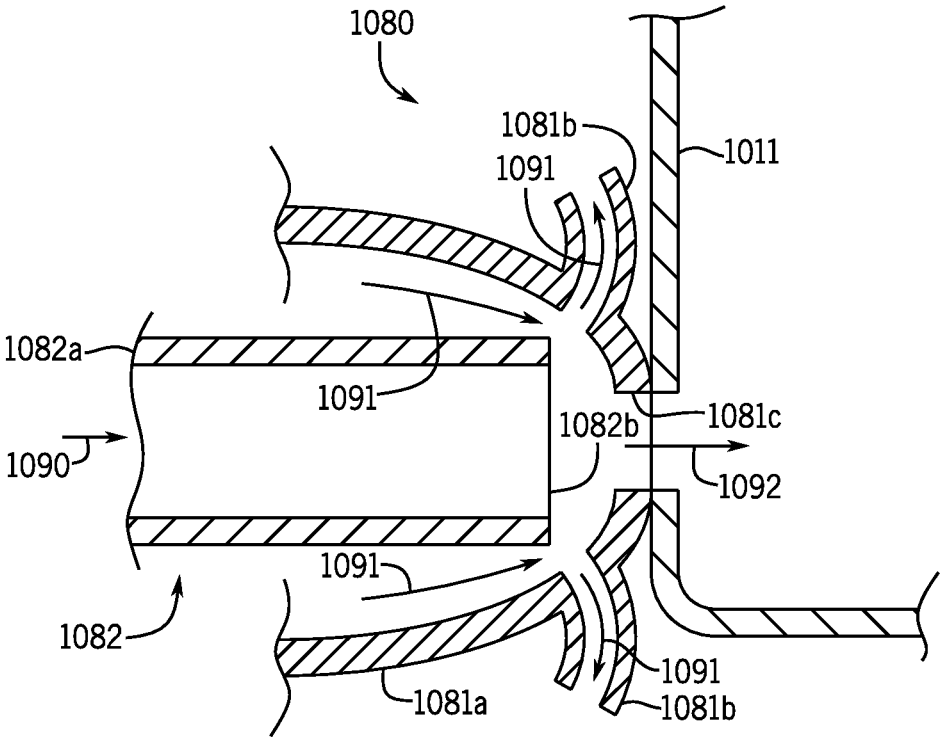

Referring to FIG. 10, a jet assembly 1080 is shown according to another exemplary embodiment. In this embodiment, the jet assembly 1080 can, advantageously, inject compressed air into a flow of water to focus/direct the flow before entering the sump of the tankless toilet resulting in improved water entrainment. As shown in FIG. 10, the jet assembly 1080 includes a housing 1081*a* coupled to, and in fluid communication with, a sump 1011 of a tankless toilet, such as tankless toilet 100. The housing 1081*a* can taper from a wider portion to a narrower portion that terminates at an outlet 1081*c* for communicating fluid into the sump 1011. The housing 1081*a* further includes one or more air conduits 1091 branching off from the housing 1081*a* near the outlet 1081*c*. The air conduits 1091 can direct excess air received from an air supply source to ambient or to an air return line for reuse by the jet assembly 1080.

Still referring to FIG. 10, the jet assembly 1080 further includes an inlet conduit 1082 (e.g., main channel, etc.) disposed within the housing 1081*a*. The inlet conduit 1082 includes an inlet portion 1082*a* coupled to, and in fluid communication with, a sump supply conduit (e.g., sump supply conduit 150) to provide a flow of water 1090 therethrough. The inlet conduit 1082 further includes an outlet portion 1082*b* located adjacent the outlet 1081*c* of the housing for communicating fluid to the sump 1011. The housing 1081*a* is also in fluid communication with an air supply source for providing a compressed air flow 1091 through an interior portion of the housing between the inlet conduit 1082 and the housing 1081*a*. The air supply source can be located remotely from the housing 1081*a* or on/in the tankless toilet. At least a portion of the compressed air flow 1091 can be injected into the flow of water 1090 at the outlet portion 1082*b* of the inlet conduit 1082 to provide a focused flow of compressed air and water 1092 through the outlet 1081*c* into the sump 1011. Any excess compressed air flow 1091 can be directed out of the housing 1081*a* through the one or more air conduits 1081*b* located adjacent the outlet portion 1082*b*. In this manner, the focused flow of compressed air and water 1092 can, advantageously, improve water entrainment to thereby prime or induce the siphon in the trapway of the tankless toilet.

Figure 11:
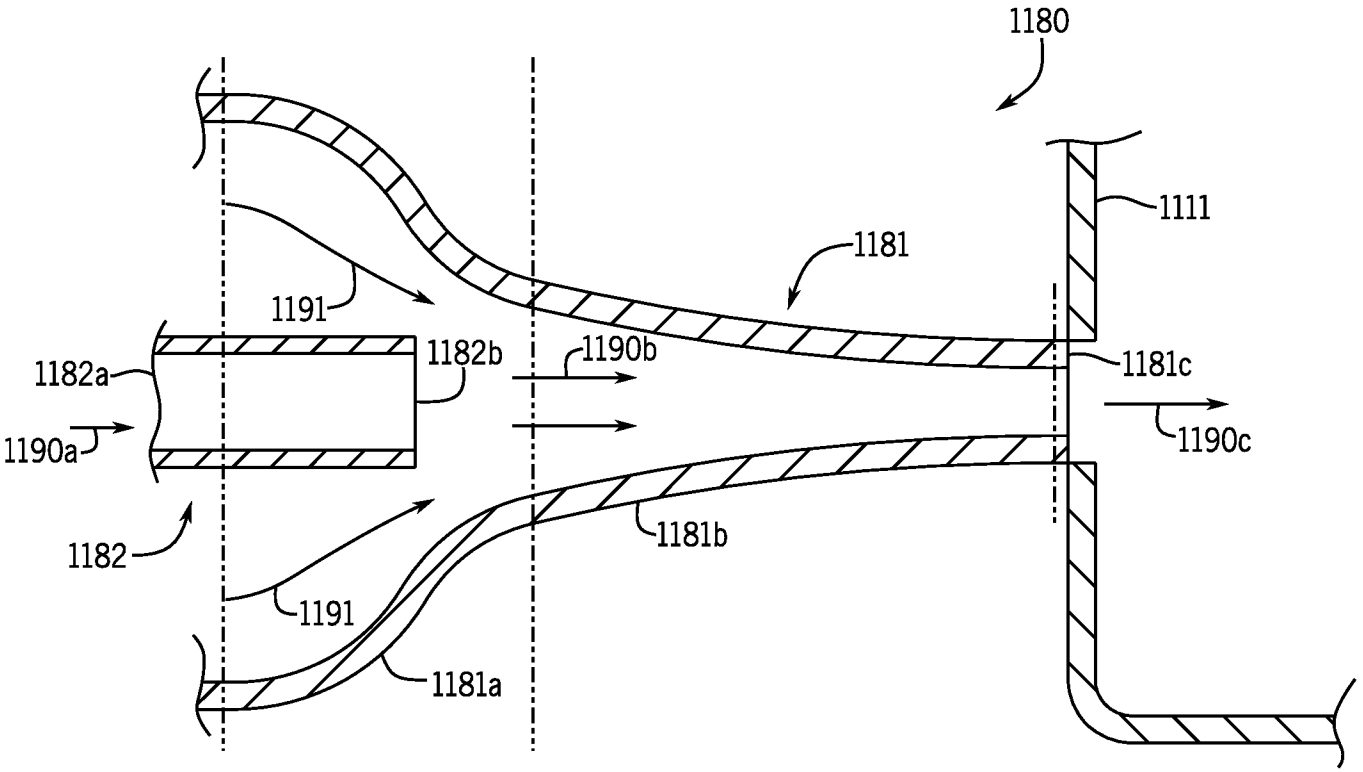

Referring to FIG. 11, a jet assembly 1180 is shown according to another exemplary embodiment. In this embodiment, the jet assembly 1180 uses a venturi to entrain additional water and amplify a flow of water before exiting the jet assembly and entering the sump. As shown in FIG. 11, the jet assembly 1180 includes a housing 1181 coupled to, and in fluid communication with, a sump 1111 of a tankless toilet, such as tankless toilet 100. The housing 1181 includes an inlet portion 1181*a* (e.g., wider portion, mouth portion, etc.), a frusto-conical portion 1181*b* (e.g., venturi portion, narrower portion, etc.), and an outlet portion 1181*c* (e.g., jet face, etc.). The housing 1181 is coupled to the sump 111 at the outlet portion 1181*c*. The housing 1181 defines an interior space for receiving a primary flow of water 1190*a* and a secondary flow of water 1191.

Still referring to FIG. 11, the jet assembly 1180 further includes an inlet conduit 1182 (e.g., main channel, etc.) disposed within the housing 1181. The inlet conduit 1182 includes an inlet portion 1182*a* coupled to, and in fluid communication with, a sump supply conduit (e.g., sump supply conduit 150) to provide a primary flow of water 1190*a* therethrough. The inlet conduit 1182 further includes an outlet portion 1182*b* located near the transition between the inlet portion 1181*a* and the frusto-conical portion 1181*b* of the housing. The housing 1181 is also in fluid communication with a secondary water supply source to provide the secondary flow of water 1191 through the interior of the housing 1181 between the inlet conduit 1182 and the housing. According to an exemplary embodiment, the secondary water supply source is a reservoir located behind the bowl wall of the tankless toilet 100. According to other exemplary embodiments, the secondary water supply source is located remotely from the tankless toilet 100.

As shown in the exemplary embodiment of FIG. 11, the inlet conduit 1182 can provide the primary flow of water 1190*a* into an interior portion of the housing 1181 adjacent a proximal end of the frusto-conical portion 1181*b* of the housing. The secondary flow of water 1191 can be introduced into the primary flow of water 1190*a* to form a combined flow of water 1190*b* within the housing 1181. The frusto-conical portion 1181*b* of the housing has a frusto-conical shape that can, advantageously, act as a venturi to entrain the secondary flow of water 1191 into the primary flow of water 1190*a* to amplify the combined flow of water 1190*b* before exiting the outlet portion 1181*c* into the sump 1111 as an entrained flow 1190*c*. In this manner, the jet assembly 1180 can improve water entrainment to thereby prime or induce the siphon in the trapway of the tankless toilet.

Figure 12:
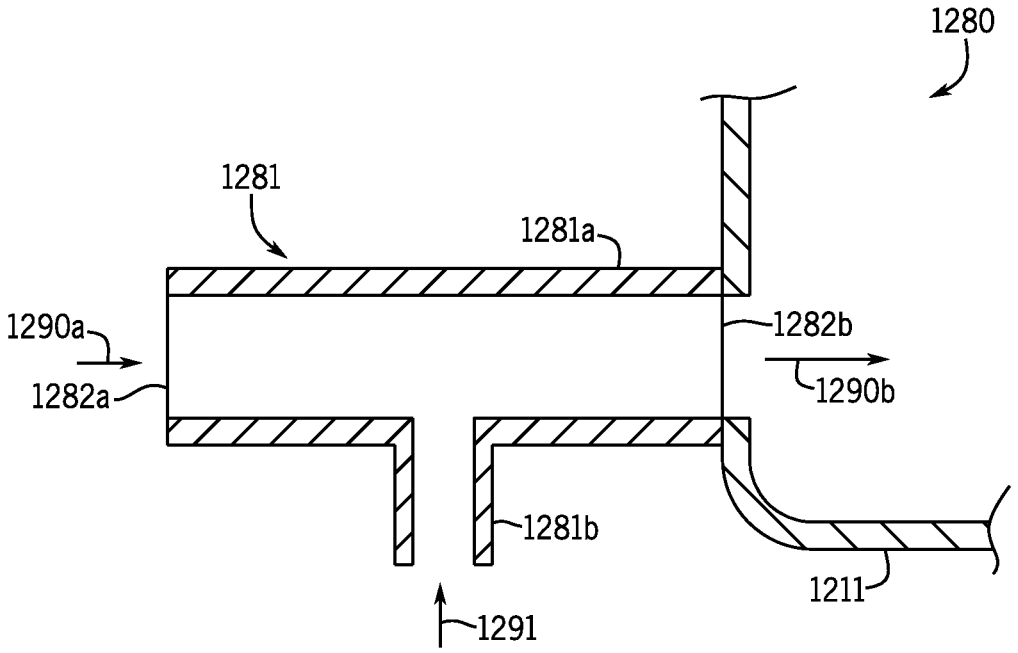

Referring to FIG. 12, a jet 1280 is shown according to another exemplary embodiment. In this embodiment, the jet 1280 introduces air into a flow of water to entrain the water or provide more power to the flow to, for example, mix media or macerate in the sump of the toilet. As shown in FIG. 12, the jet 1280 includes a housing 1281 coupled to, and in fluid communication with, a sump 1211 of a tankless toilet, such as tankless toilet 100. The housing 1281 includes a primary conduit 1281*a* (e.g., main channel, first channel, etc.) and a secondary conduit 1281*b* (e.g., secondary channel, second channel, etc.). The secondary conduit 1281*b* is coupled to, and in fluid communication with, the primary conduit 1281*a*. The secondary conduit 1281*b* is also in fluid communication with an air supply source to provide an air flow 1291 to the primary conduit 1281*a*. According to the exemplary embodiment shown, the secondary conduit 1281*b* is oriented transverse to the primary conduit 1281*b*, although it is appreciated that the secondary conduit 1281*b* may be oriented differently relative to the primary conduit 1281*a*. The primary conduit includes an inlet portion 1282*a* and an outlet portion 1282*b* (e.g., jet face, etc.). The inlet portion 1282*a* is coupled to, and in fluid communication, with a sump supply conduit (e.g., sump supply conduit 150) to provide a flow of water 1290*a* therethrough. The jet 1280 is fluidly coupled to the sump 1211 at the outlet portion 1282*b*.

Still referring to FIG. 12, the secondary conduit 1281*b* can direct the air flow 1291 from the air supply source to the primary conduit 1281*a* before the outlet portion 1282*b*. The air supply source can be located remotely from the tankless toilet 100 or can be local to the tankless toilet 100. The air flow 1291 can be introduced into the flow of water 1290*a* to, advantageously, entrain the flow of water 1290*a* and provide an entrained flow of air and water 1290*b* into the sump 1211. In this manner, the jet 1280 can improve water entrainment to thereby prime or induce the siphon in the trapway of the tankless toilet.

Figure 13:
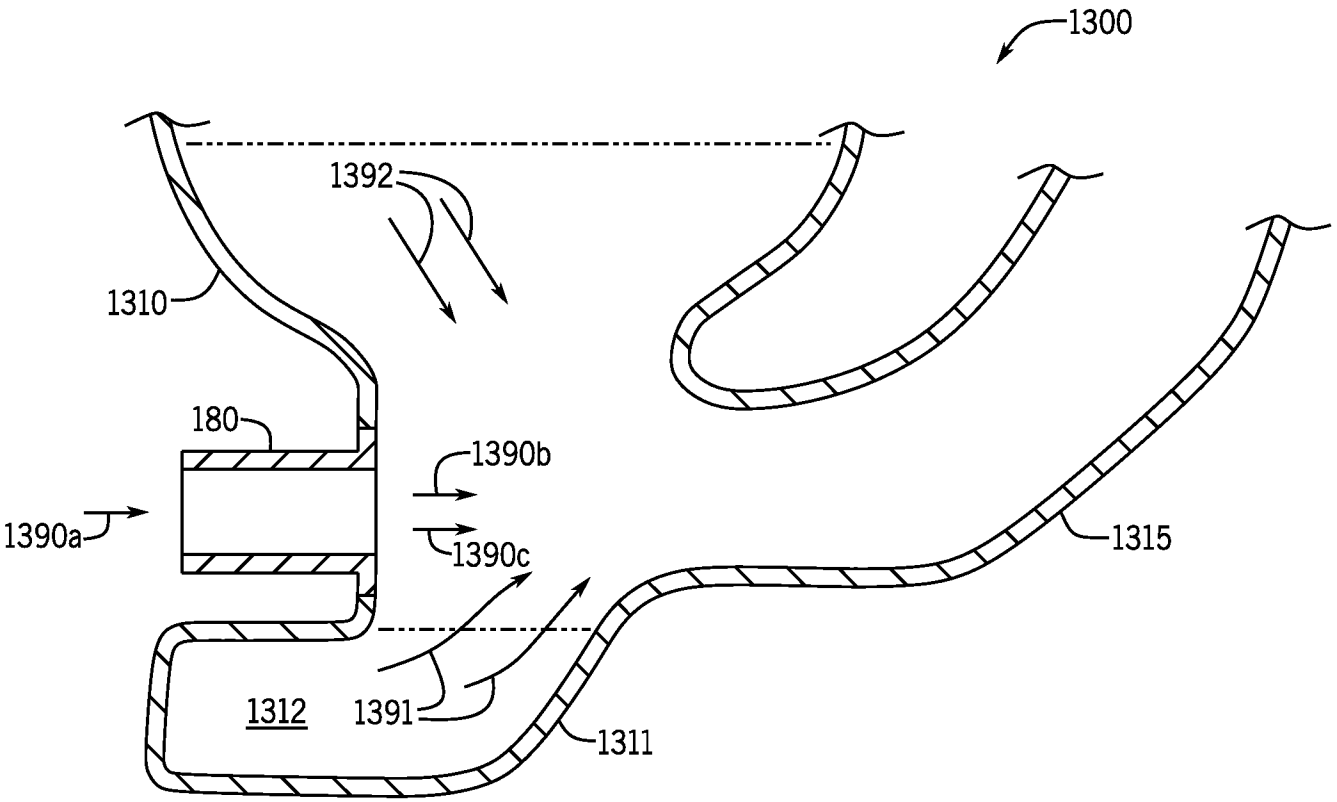

Referring to FIG. 13, a tankless toilet 1300 is shown according to another exemplary embodiment. According to an exemplary embodiment, the tankless toilet 1300 includes a plurality of jets located at different locations within the sump area of the toilet to entrain and amplify the flow. According to another exemplary embodiment, the tankless toilet 1300 includes an additional water reservoir in addition to the water stored in the bowl for improved entrainment of the jet orifices.

In the embodiment shown in FIG. 13, the tankless toilet 1300 includes a secondary reservoir 1312 defined by a lower portion 1311 of the toilet. The secondary reservoir 1312 is disposed below the jet 180, and can, advantageously, provide a secondary flow of water 1391 (e.g., secondary volume of water, etc.) to improve entrainment of at least the lower jet orifices of the jet 180. The tankless toilet 1300 further includes a bowl portion 1310 that can provide a primary flow of water 1392 (e.g., a primary volume of water, etc.) for entrainment of the upper and/or lower outlet orifices of the jet 180. For example, the jet 180 can receive a flow of water 1390*a* from a sump supply conduit (e.g., sump supply conduit 150). The jet 180 can direct and amplify the flow of water 1390*a* to produce a plurality of upper streams of water 1390*b* (e.g., from outlet orifices 186*a* and 186*b*) and a plurality of lower streams of water 1390*c* (e.g., from outlet orifices 186*c* and 186*d*). The secondary flow of water 1391 from the secondary reservoir 1312 can, advantageously, improve entrainment of at least the lower streams of water 1390*c* exiting the jet 180 within the sump of the tankless toilet. Similarly, the primary flow of water 1392 can be entrained by at least the upper streams of water 1390*b* exiting the jet 180. In this manner, the secondary flow of water 1391 from the secondary reservoir 1312 can improve water entrainment to thereby prime or induce the siphon in the trapway of the tankless toilet. According to another exemplary embodiment, the tankless toilet 1300 can include a plurality of jets 180 located at different locations within the sump area of the tankless toilet.

According to various exemplary embodiments, the tankless toilet (e.g., tankless toilet 100, etc.) can include a controller (e.g., controller 190) operatively coupled to the jet, such as jet 180, or any of the other various jet configurations described above. The controller (e.g., controller 190) can be programmed to detect a syphon event occurring in the tankless toilet using one or more sensors, and in response, can control the jet. For example, a sensor (e.g., optical sensor, flow rate sensor, pressure sensor, sound sensor, water contact/moisture sensor, etc.) can be coupled within the bowl, such as at a back half of the waterway, above or below the waterline within the bowl, or in a separate water chamber below the waterline of the bowl. The sensor can either sense a siphon event or correlate to when the siphon event would occur based on characteristics of the water within the bowl/chamber. In response, the sensor can provide a feedback signal to the jet via the controller to change, for example, the flow rate of the jet and/or other characteristics of the jet (e.g., relative position/angle, etc.). According to an exemplary embodiment, the sensor can determine when a siphon event is about to occur by detecting changes in water level over time or by determining whether the water level is at or below a threshold level, which can indicate a siphon event is imminent. According to an exemplary embodiment, the feedback signal can be sent to a valve or switch that can restrict or stop the flow of water to the jet from the sump supply conduit (e.g., sump supply conduit 150), and can redirect the flow through the rim (e.g., rim jet, etc.), which can, advantageously, lower water usage or improve the cleansing characteristics of the flush by directing water designated for the sump jet to the rim and bowl area. In this manner, the jet can be selectively controlled which can, advantageously, help to minimize water usage.

According to an exemplary embodiment, water usage by the tankless toilet (e.g., tankless toilet 100) may be controlled by restricting flow at the jet (e.g., jet 180, etc.) during a siphon event by introducing air in the jet flow to reduce the volume of water displaced though the jet. For example, air can be introduced by a conduit in fluid communication with the jet. The conduit can be in fluid communication with an air supply source, which can provide an air flow to the conduit/jet. The amount of air introduced into the jet flow can be controlled by a controller (e.g., controller 190) in operative communication with the air supply source. According to another exemplary embodiment, the flow through the jet can be restricted at the nozzle of the jet by using, for example, an adjustable orifice or by obstructing one or more of the jet nozzles/orifices to reduce water usage by the jet. For example, the size of the orifice(s) could be restricted via movable parts in either rotation or displacement shutoff (e.g., similar to a pin in a carburetor float) that would restrict or block channels of the flow as desired. The moveable parts can be controlled via a controller, such as controller 190. In this manner, the amount of water used by the jet can be controlled to thereby reduce water usage by the tankless toilet.

According to various exemplary embodiments, the tankless toilet (e.g., tankless toilet 100, etc.) can be configured for dual-flush operation with the sump jet (e.g., jet 180, etc.). For example, the tankless toilet can be tuned for evacuation of liquid waste in a first flush operation where less water is required to evacuate the toilet bowl (e.g., no solid waste to evacuate) by proactive sensing from a bowl sensor or actuation from a toilet seat, trip lever, or remote button, which could instruct the jet assembly to restrict or eliminate the water flow during the first flush operation, and redirect water to, for example, the rim jet to reduce the amount of water used by the jet and/or improve rim washing performance.

According to various exemplary embodiments, the tankless toilet (e.g., tankless toilet 100, etc.) and/or the sump jet (e.g., jet 180, etc.) can be configured to provide a pulsed flow of water to the sump (e.g., sump 111, etc.) instead of a constant flow. For example, instead of a constant flow of water through the jet, the introduction of air or interrupting the flow of water can reduce overall water consumption (e.g., this functionality could operate similarly to LED lighting on a duty cycle, where current is cycled on and off to lower the overall energy consumption while achieving the same brightness performance). In this way, the tankless toilet can reduce the amount of water used during a flush operation.

According to an exemplary embodiment, introducing a pulsed flow or introducing air into the water flow of the jet (e.g., jet 180, etc.) can occur when media/waste is removed from the bowl, or when the siphon has begun and the jet is not performing as much "work," which would be most beneficial from an efficiency standpoint. According to another exemplary embodiment, pulsing the water flow or introducing air can occur during the initial charging phase of the siphon, which may help to break or pulverize solid masses/media to reduce the typical water flow rates required to achieve acceptable flushing performance for bulk waste. According an exemplary embodiment, air can be introduced to the jet assembly through the jet water way/conduit or through independent air conduits/nozzles in fluid communication with the jet. The air can, advantageously, clean an interior portion of the water jet geometries. According to an exemplary embodiment, air can be used to randomize or redirect the entrainment jet profiles to thereby broaden the outlet low or area of water pushing on the waste material. According to various exemplary embodiments, the pulsing can be constant or variable based on the type of flush selected (e.g., in a dual flush configuration). According to other exemplary embodiments, the air flow can be triggered/activated only during the stages when the jet would normally be "wasting" water flow/energy, such as when the bowl is clear of waste. The pulsing of air or water can be random depending on when it is deemed most beneficial through the flush cycle or needed for nozzle/orifice cleaning of the jet. According to various exemplary embodiments, the air flow provided to the jet can be created via various methods, such as from structural geometries that could cause turbulent flow within the jet, an air compressor, a CO2 cartridge, or an air blatter/piston chamber that could be selectively actuated during a flush to provide a supply of air to the jet. According to an exemplary embodiment, a pulsed water flow can be created via movable geometry/features within the jet assembly that can rotate relative to the jet and selectively block or restrict flow around a track (e.g., similar to a pulse spray mode in a hand sprayer), or via restrictive sizing of the movable features to block/limit the flow through the inlet or outlet geometry of the jet.

According to various exemplary embodiments, the various jet configurations described above can include an air inlet to facilitate cleaning of the jet/outlet orifices and/or the sump area of the tankless toilet. For example, the various jets can include an aperture or other feature for introducing air into an interior portion of the jet (e.g., the main channel, etc.) from an air supply source. The air can, advantageously, act as an emulsifier to clean an interior portion of the jet and/or at least a portion of the sump area of the tankless toilet.

As described above, the tankless toilet produces a siphon effect even under low supply line pressures and using a nominal 0.5-inch diameter hose, which together may provide a flow rate of water as little as 4.6 gpm. This occurs because water contained within the sump undergoes flow entrainment when water flowing out from the various jet configurations enters the sump and rapidly diffuses outwardly. As the flow from the jet enters the still water of the sump, counter-rotating vortex pairs are created, drawing in the still fluid and speeding it up in the forward direction. This flow amplification provides the necessary high flow rate (e.g., about 20 to 25 gpm) into the trapway to prime or induce the siphon and evacuate the bowl through suction pressure. Thus, the still water contained in the sump acts as the water reservoir, eliminating the need for a separate tank like in gravity-based toilet designs.

Moreover, due to the effect of flow entrainment in inducing the siphon, larger bowl volumes in the sump (e.g., 0.8-gallon bowl volume) may further enhance flow rate amplification. By providing a larger bowl volume, soiling of the inner surface of the bowl in between flushes may be prevented, thereby increasing overall cleanliness of the bowl. In addition, because the bowl volume of the sump is now "working" water that helps prime the siphon in the trapway, less water is wasted and total water consumption may be decreased. For example, in certain embodiments, a tankless toilet 100 including a jet 180 having the four outlet orifices **186*a*-186*d* shown in FIG. 3 and a sump 111** having a bowl volume of about 0.8 gallons may consume a total of about 1.1 gallons of water during a flush. This water consumption rate is even more water-conserving when compared to current high-efficiency toilets operating at a water consumption rate of about 1.28 gallons per flush.

The tankless toilet 100 described herein provides a low-profile design that can be easily adapted to existing plumbing contained in typical residential homes and eliminates the requirement for elevated supply line pressures. Thus, handling and installation of the toilet is made simpler and the overall aesthetic design is improved. Moreover, because the tankless toilet 100 relies on a siphon action, sound pressure levels are lower than in blow-out designs, while still maintaining bulk material removal performance comparable to the blow-out designs. The tankless toilet 100 also provides a toilet having lower water consumption rates while still maintaining a higher level of overall cleanliness.

In one embodiment, a tankless toilet includes a bowl, a trapway, and a jet. The bowl includes a rim at an upper portion of the bowl and a sump at a lower portion of the bowl. The trapway extends from the sump to a drain. The jet includes a main channel configured to receive a supply of water from a supply conduit, and a plurality of distribution channels configured to introduce water received from the main channel to at least one of the sump and the trapway. The jet is configured to receive the supply of water from the supply conduit at a first flow rate and introduce the supply of water to the at least one of the sump and the trapway at a second flow rate greater than the first flow rate to prime or induce a siphon within the trapway. The second flow rate is greater than the first flow rate prior to inducing the siphon.

In one aspect, which is combinable with the above embodiment, the water supply conduit is connected to a water supply line that provides a water pressure of about 30 psi.

In one aspect, which is combinable with any of the above embodiments or aspects, the jet supplies water to the sump at an upward angle relative to a bottom surface of the sump.

In one aspect, which is combinable with any of the above embodiments or aspects, the plurality of outlet orifices include four outlet orifices. According to other embodiments, there may be greater or fewer outlet orifices.

In one aspect, which is combinable with any of the above embodiments or aspects, the plurality of outlet orifices are rectangular in shape. According to other exemplary embodiments, the shape may be non-rectangular.

In one aspect, which is combinable with any of the above embodiments or aspects, the jet is attached to the sump.

In one aspect, which is combinable with any of the above embodiments or aspects, the jet is attached to a lower portion of a trapway leading from the sump.

In one aspect, which is combinable with any of the above embodiments or aspects, the jet is attached to an upper portion of a trapway leading from the sump.

In one aspect, which is combinable with any of the above embodiments or aspects, the bottom surface of the sump is downwardly angled relative to the jet.

In one aspect, which is combinable with any of the above embodiments or aspects, the water supply conduit is a hose.

In one aspect, which is combinable with any of the above embodiments or aspects, the plurality of distribution channels are narrower than the main channel.

In another embodiment, a jet for introducing water into a sump of a tankless toilet includes a main channel configured to receive water from a water supply and at least one outlet orifice configured to supply the water to the sump. The main channel is configured to distribute the water through at least one distribution channel that leads to the at least one outlet orifice.

In one aspect, which is combinable with the above embodiment, the at least one outlet orifice is rectangular in shape. According to other exemplary embodiments, the shape may be non-rectangular.

In one aspect, which is combinable with any of the above embodiments or aspects, the at least one outlet orifice includes four outlet orifices. According to other embodiments, there may be greater or fewer outlet orifices.

In one aspect, which is combinable with any of the above embodiments or aspects, the at least one outlet orifice has a width and a height, the width being greater than the height.

In one aspect, which is combinable with any of the above embodiments or aspects, the at least one distribution channel is narrower than the main channel.

In yet another embodiment, a method for flushing a tankless toilet having a bowl using a siphon action includes providing a first water flow to a rim provided at an upper portion of the bowl for a first predetermined time interval, providing a second water flow to a jet connected to a sump provided at a lower portion of the bowl for a second predetermined time interval, and providing a third water flow to the rim for a third predetermined time interval. The jet includes a main channel configured to receive the second water flow and a plurality of outlet orifices configured to supply the second water flow to the sump. The main channel is configured to distribute the second water flow through a plurality of channels that lead to the plurality of outlet orifices.

In yet another embodiment, a plumbing fixture includes a bowl, a trapway, and a jet. The bowl includes a rim at an upper portion of the bowl and a sump at a lower portion of the bowl. The bowl is configured to hold a volume of water therein. The trapway extends from the sump to a drain. The jet includes a main channel configured to receive a supply of water from a supply conduit and to direct the supply of water to at least one of the sump and the trapway. The jet is configured to receive the supply of water from the supply conduit at a first flow rate and introduce the supply of water to the at least one of the sump and the trapway at a second flow rate greater than the first flow rate to entrain the volume of water in the bowl and prime or induce a siphon within the trapway. The second flow rate is greater than the first flow rate prior to inducing the siphon.

In one aspect, which is combinable with any of the above embodiments or aspects, the main channel includes a spiral feature configured to spin at least a portion of the supply of water prior to entering the at least one of the sump and the trapway.

In one aspect, which is combinable with any of the above embodiments or aspects, the plumbing fixture further comprises an air conduit coupled to, and in fluid communication with, the main channel, wherein the air conduit is configured to introduce a supply of air into the main channel.

In one aspect, which is combinable with any of the above embodiments or aspects, the main channel is positioned to introduce water into a lower portion of the trapway.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the application as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present application.

What is claimed is:

1. A toilet comprising:

a bowl including a rim at an upper portion of the bowl and a sump at a lower portion of the bowl;

a trapway extending from the sump to a drain; and a sump jet coupled to the sump and configured to rotate relative to the sump, the sump jet including a main channel configured to receive a supply of water from a supply conduit and a spiral feature configured to entrain the supply of water in a spiral to induce a siphon in the toilet.

2. The toilet of claim 1, wherein the spiral feature includes a spiral rib, a spiral protrusion, a spiral channel, a helical rib, or a helical channel.

3. The toilet of claim 1, wherein the spiral feature includes a plurality of ribs or a plurality of channels.

4. The toilet of claim 1, wherein at least a portion of the spiral feature extends through the main channel.

5. The toilet of claim 1, wherein the sump jet is configured to receive the supply of water from the supply conduit at a first flow rate and induce a flow from the supply of water into the trapway at a second flow rate greater than the first flow rate to prime a siphon within the trapway.

6. The toilet of claim 5, wherein the second flow rate is greater than the first flow rate prior to priming the siphon.

7. The toilet of claim 1, further comprising:

a rim jet fluidly coupled to the supply conduit and configured to introduce water at the rim of the bowl.

8. The toilet of claim 7, further comprising:

a first valve fluidly coupled to the rim jet and a second valve fluidly coupled to the sump jet, wherein the first and second valves selectively provide water from the supply conduit to the rim jet and the sump jet to provide a multi-stage flush cycle.

9. A method for flushing a toilet, the method comprising:

providing a first water flow from a supply conduit to a rim jet of a bowl for a first time interval; and providing a second water flow from the supply conduit to at least one of a sump and a trapway of the toilet via a sump jet for a second time interval to prime a siphon within the trapway;

wherein the sump jet is coupled to the sump and configured to rotate relative to the sump, wherein the sump jet includes a main channel configured to receive water from the supply conduit, and a spiral feature configured to entrain the water in a spiral to induce a siphon in the toilet.

10. The method of claim 9, further comprising:

providing a third water flow from the supply conduit to the rim jet for a third time interval.

11. The method of claim 9, wherein the spiral feature includes a spiral rib, a spiral protrusion, a spiral channel, a helical rib, or a helical channel.

12. The method of claim 9, wherein at least a portion of the spiral feature extends through the main channel.

13. The method of claim 9, wherein the sump jet is configured to receive the water from the supply conduit at a first flow rate and induce a flow from the water into the trapway at a second flow rate greater than the first flow rate to prime the siphon within the trapway.

14. The method of claim 13, wherein the second flow rate is greater than the first flow rate prior to priming the siphon.

15. The method of claim 9, further comprising:

a rim jet fluidly coupled to the supply conduit and configured to introduce water at the rim of the bowl.

16. A plumbing fixture, comprising:

a bowl including a rim at an upper portion of the bowl and a sump at a lower portion of the bowl;

a trapway extending from the sump to a drain; and a sump jet coupled to the sump and configured to rotate relative to the sump, the sump jet including a main channel configured to receive a supply of water from a residential supply conduit at a household supply line pressure and a spiral rib, a spiral protrusion, a spiral channel, a helical rib, or a helical channel configured to entrain the water in a spiral to induce a siphon in the plumbing fixture.

17. The plumbing fixture of claim 16, wherein at least a portion of the spiral rib, the spiral protrusion, the spiral channel, the helical rib, or the helical channel extends through the main channel.

18. The plumbing fixture of claim 16, wherein the sump jet is configured to receive the supply of water from the supply conduit at a first flow rate and induce a flow from the supply of water into the trapway at a second flow rate greater than the first flow rate to prime a siphon within the trapway.

* * * * *